US006723001B2

(12) United States Patent
Ferris

(10) Patent No.: US 6,723,001 B2
(45) Date of Patent: Apr. 20, 2004

(54) HANDLE CONFIGURATION FOR A PUTTER TYPE GOLF CLUB

(76) Inventor: Richard D. Ferris, 3521 Glenbrook Rd., Fairfax, VA (US) 22031

( * ) Notice: Subject to any disclaimer, the term of this patent is extended or adjusted under 35 U.S.C. 154(b) by 0 days.

(21) Appl. No.: 10/238,585

(22) Filed: Sep. 11, 2002

(65) Prior Publication Data

US 2003/0130058 A1 Jul. 10, 2003

Related U.S. Application Data

(60) Provisional application No. 60/359,724, filed on Feb. 27, 2002, and provisional application No. 60/344,376, filed on Jan. 4, 2002.

(51) Int. Cl.[7] ..... A63B 53/14

(52) U.S. Cl. ..... 473/251; 473/300; 473/313; 473/314; 473/294

(58) Field of Search ..... 473/313–315, 473/300–303, 203–204, 251–252, 268, 201, 294

(56) References Cited

U.S. PATENT DOCUMENTS

| | | | | |
|---|---|---|---|---|
| 740,500 | A | | 10/1903 | White |
| 2,781,196 | A | | 2/1957 | Brandon ..... 273/81.3 |
| 3,109,653 | A | | 11/1963 | Biggs ..... 273/165 |
| 3,459,429 | A | | 8/1969 | Sherwood ..... 273/81 |
| 3,574,349 | A | | 4/1971 | Kropp ..... 273/81 |
| 3,782,725 | A | | 1/1974 | Giambazi ..... 273/81.3 |
| 4,310,158 | A | | 1/1982 | Hoffman ..... 273/81.3 |
| 4,426,083 | A | * | 1/1984 | Dishner, Jr. ..... 473/252 |
| 4,537,403 | A | | 8/1985 | Farina ..... 273/164 |
| 4,746,120 | A | | 5/1988 | Mockovak ..... 273/81.5 |
| 5,058,891 | A | * | 10/1991 | Takeuchi ..... 473/201 |
| 5,133,555 | A | | 7/1992 | Bailey ..... 273/164 |
| 5,209,470 | A | * | 5/1993 | Cimaroli et al. ..... 473/241 |
| 5,209,474 | A | | 5/1993 | Voyer ..... 273/80 C |
| D355,011 | S | | 1/1995 | Subnick ..... D21/222 |
| D355,444 | S | | 2/1995 | Deluca ..... D21/222 |
| 5,398,934 | A | * | 3/1995 | Soong ..... 473/299 |
| 5,431,401 | A | * | 7/1995 | Smith ..... 473/251 |
| 5,460,372 | A | | 10/1995 | Cook ..... 273/81 R |
| 5,544,879 | A | | 8/1996 | Collins ..... 473/314 |
| D377,070 | S | | 12/1996 | Gurrola ..... D21/222 |
| 5,679,080 | A | | 10/1997 | Finsterwald ..... 473/206 |
| 5,779,559 | A | * | 7/1998 | Eberle ..... 473/294 |
| 5,993,327 | A | | 11/1999 | Terril ..... 473/297 |
| 6,110,054 | A | | 8/2000 | Rodarte ..... 473/203 |
| 6,277,031 | B1 | | 8/2001 | Cheek et al. ..... 473/294 |
| 6,296,577 | B1 | | 10/2001 | Trammell et al. ..... 473/340 |
| 6,506,128 | B1 | * | 1/2003 | Bloom, Jr. ..... 473/292 |
| 6,511,386 | B1 | * | 1/2003 | Cacicedo ..... 473/300 |

* cited by examiner

*Primary Examiner*—Stephen Blau
(74) *Attorney, Agent, or Firm*—Welsh & Flaxman LLC

(57) ABSTRACT

A putter type golf club including a club head with a ball striking face lying in a plane and a shaft connected to the club head. The golf club is formed with an elongated handle, having a cross-sectional configuration with a first length in a direction perpendicular to the plane of said ball striking face and a second length in a direction parallel to the plane of said ball striking face; the first length being greater than the second length and the cross-sectional shape being generally oval, including rounded front and rear edges. Alignment indicia is provided on a top surface of the handle to assist the golfer to properly align the golf club in order to execute a putting stroke toward an intended target.

5 Claims, 4 Drawing Sheets

HANDLE CONFIGURATION FOR A PUTTER TYPE GOLF CLUB

CROSS REFERENCE TO RELATED APPLICATIONS

This is application is based upon prior provisional applications Serial No. 60/344,376, filed Jan. 4, 2002 entitled "GOLF PUTTER HANDLE" and Serial No. 60/359,724, filed Feb. 27, 2002 entitled "GOLF (CLUB) PUTTER HANDLE".

BACKGROUND OF THE INVENTION

The present invention relates to an apparatus used for playing a game of golf and in particular to a putter type golf club having a unique handle configuration.

The game of golf is a game played with typically fourteen different golf club implements for hitting a golf ball from a teeing area into a hole on a putting green in the least number of strokes. Typically golf holes may be as short as 100 yards and as long as 600 plus yards. The putting green is a smooth well manicured surface at the far end of the golf hole, having a relatively small hole and directional pin which serves as the target for the golfer in playing the game. Once a golf ball reaches the smooth putting surface, a putter type golf club having a low lofted ball striking face, usually less than 6 degrees of loft, is used to roll the ball across the putting surface in a direction toward the hole. Typically a putting stroke, as opposed to a longer more forceful swing used with the other clubs for moving the ball much longer distances, is made by a golfer using only the hands, arms and shoulders, with the rest of his body in a relatively stable and still condition.

There are three main factors which influence the direction and distance that a golf ball rolls when being struck by a putter, namely the face angle of the putter at impact relative to the intended target line, the path of the club head relative to the target line and the point on the club face where the ball is struck relative to the center of percussion. Of these three factors the most important is the face angle direction. Therefore, a golfer must develop a putting stroke which maintains the face angle at a constant angular position during the execution of the stroke, if the golfer is to become proficient in the art of putting. Typically hand and wrist movement during a golf stroke will open and close the club face which directly results in a ball rolling in a direction away from the intended direction line. In order to achieve and maintain a constant ball striking face angle during the putting stroke, it has been found that elimination of hand movement during the stroke, such that the stroke is executed primarily by the shoulders and upper arms, produces the most consistent results.

Traditional golf type putters include a putter head having a single ball striking face for stroking a ball, an elongated shaft connected thereto and a generally cylindrical, tapered handle. This type of handle or grip make it difficult to maintain the club face in a square position relative to a given target line and various attempts have been made to modify putters in an attempt to keep the ball striking club face square to the line during the execution of a stroke.

For example, golf putters with elongated shafts and shafts which engage parts of the golfer's torso are conventually used in an attempt to minimize hand movement. Such examples of these type of prior art putters are shown in U.S. Pat. No. 5,209,474 to Voyer, U.S. Pat. No. 5,544,879 to Collins and U.S. Pat. No. 6,296,577 to Trammell et al. among many others.

The shape of the putter handle has been modified in keeping within the rules of golf, as prescribed by the U.S. Golf Association, require that the handle of a golf club be symmetrical along it's entire length. It is well known to use putter grips with a flat surface perpendicular to the club face for the purpose of providing a reference point to aid a golfer in keeping the ball striking face square to the target at impact with the golf ball. This structure conforms with the rules of golf. Other golf grip handles which include at least one flat surface are shown in U.S. Pat. No. D355,011 to Subnick, U.S. Pat. No. 3,459,426 to Sherwood, U.S. Pat. No. 4,537,403 to Farina and U.S. Pat. No. 5,993,327 to Terrell.

Still other prior art putter handle structures are disclosed in U.S. Pat. No. 3,109,653 to Biggs, U.S. Pat. No. 4,537403 to Farina, U.S. Pat. No. 5,460,372 to Cook, U.S. Pat. No. 4,746,120 to Mockovak, U.S. Pat. No. D377,070 to Gurrola, U.S. Pat. No. D355,444 to Deluca, U.S. Pat. No. 5,133,555 to Bailey, and U.S. Pat. No. 6,110,054 to Rodarte among many others.

SUMMARY OF THE INVENTION

It is, therefore, an object of the present invention to provide an improved golf putter grip/handle having a unique configuration which promotes improved and consistent stroke control, stroke direction and distance thereby facilitating more predictable accurate and successful putting. This, in turn, creates a more enjoyable and satisfying golfing experience.

The handle has a generally oval shape when viewed in cross-section. In the preferred embodiment both ends of the oval shaped cross-section are arcuate with one end having a radius of curvature greater than the other and the sides are straight. The wide side of the handle is perpendicular to the plane along the ball striking face and parallel to a line in a direction toward an intended target. The ends of the handle are rounded along the entire elongated length of the handle between the club head and the top of the putter. In a preferred embodiment, the forward edge of the handle, toward the target direction has a first, larger radius whereas the rearward edge has a smaller radius. Wide, flat sides between the rounded forward and rearward edges taper from the forward edge radius to the rearward edge radius.

A second embodiment of the handle, in accordance with the present invention, is formed with a true oval, cross section with the longer elongated or longitudinal axis being parallel to the target line and perpendicular to the plane along the ball striking face of the club head.

All embodiments of the handle include a flat upper surface preferably cut at an angle parallel to the plane of the bottom of the putter head whereby the top of the handle is horizontal when the putter rests flat on a support surface, such as a putting green or the like. The upper surface includes alignment marks. The alignment marks are in the shape of a cross-hair, with a first line being located along the longer elongated or longitudinal axis of the oval in a direction toward the target and a second shorter line, crossing the first line, in a direction generally perpendicular to the target line.

The shaft of the golf club is connected directly into a lower end of the handle. The shaft may be connected at various points along the bottom of the handle as long as the rearward edge of the handle is offset from the center of the shaft. In one embodiment, the shaft is connected toward the forward edge of the handle. In another embodiment the shaft is connected closer to the center of the handle.

When the handle is grasped by a golfer, the oval cross-sectional shape of the handle having flat sides and rounded ends, tend to significantly reduce the wrist movement and flex normally encountered with a round handle during the execution of a putting stroke. The elimination of the wrist flex keeps the ball striking face in a square position relative to the intended target line longer thus improving stroke direction and distance. Because the handles greatest diameter is in a direction parallel with the direction of the putting stroke, the stroke path tends to become flatter toward the horizontal which results in a longer, in-line ball striking zone where the face remains essentially square. The unique handle construction because of its length in the direction toward the club head allows the handle to be gripped by a split hand grip where the right and left hands are separated vertically along the length of the handle and the dominant hand is much lower than the non-dominant hand. For a right handed golfer the dominant hand would be the right hand and the non-dominant hand would be the left hand. The putter may also be used with a forearm press type grip which positions a significant length of the putter handle against the dominate forearm, for example the right forearm for a right handed golfer, in an attempt to keep the right hand quiet during the stroke. The anterior bulge in the shape of the reducing oval of the handle gives a purchase to the left hand to grasp the handle and press it to the right forearm without having the hand encompass the handle which would prevent the proper positioning of the handle directly to the forearm. This handle configuration forces the lower gripping dominant hand to be located behind the shaft.

Using this grip the user's dominate hand, usually the trailing hand, is placed lower on the handle, whereas the leading hand is placed high on the handle and in front of the putter head. Because the trailing hand is offset rearwardly, increased direction stroke control is achieved by the trailing hand. The placement of the hands on the flattened handle greatly reduces stroke pressure on the wrists of the user, all but eliminating the wrist and hands as a pivot point and moving the same to the upper portions of the arms and shoulders.

The cross-hair alignment marks on the top of the putter head are in a direct line of sight of the golfer as he applies his hands to the handle and lines up the putt to the intended target. The longer alignment line, across the longitudinal axis of the oval cross section of the top of the handle, is preset exactly at 90° to the plane of the putter face and therefore reflects the direction that the putter face is aimed toward the intended target. The second line of the cross hair is parallel to the direction of the putter face. Once an intended target line is selected, this second line must be perpendicular to the target direction line in order for the club face to be square to the target. The golfer is able to use these alignment marks in conjunction with similar markings on the putter head as an aide to putter head alignment, as well as stroke direction, to insure that the club face is maintained perpendicular to the target during the execution of a putting stroke.

An object of the present invention is the provision of a putter type golf club having an improved handle structure to promote putting stroke accuracy.

Another object of the present invention is the provision of a putter type golf club having a handle to enable the golfer to more readily determine the correct position of the club head relative to the horizontal green surface.

Still another object of the present invention is the provision of a putter type golf club having a handle which promotes feel and control with both hands and forces the dominant hand to be located on an offset behind the rear edge of the shaft.

Another object of the present invention is the provision of a putter type golf club having a handle with alignment indicia to assist the golfer to locate the putter relative to an intended target line resulting in increased putting accuracy.

Yet another object of the present invention is the provision of a putter type golf club having a handle which promotes a variety of putting grips including a split grip and a conjoined hands grip.

Other objects, advantages and salient features of the invention will become apparent from the following detailed description, which taken in conjunction with the annexed drawings, discloses preferred, but non-limiting, embodiments of the subject invention.

DESCRIPTION OF THE PREFERRED EMBODIMENTS

Figure 2:
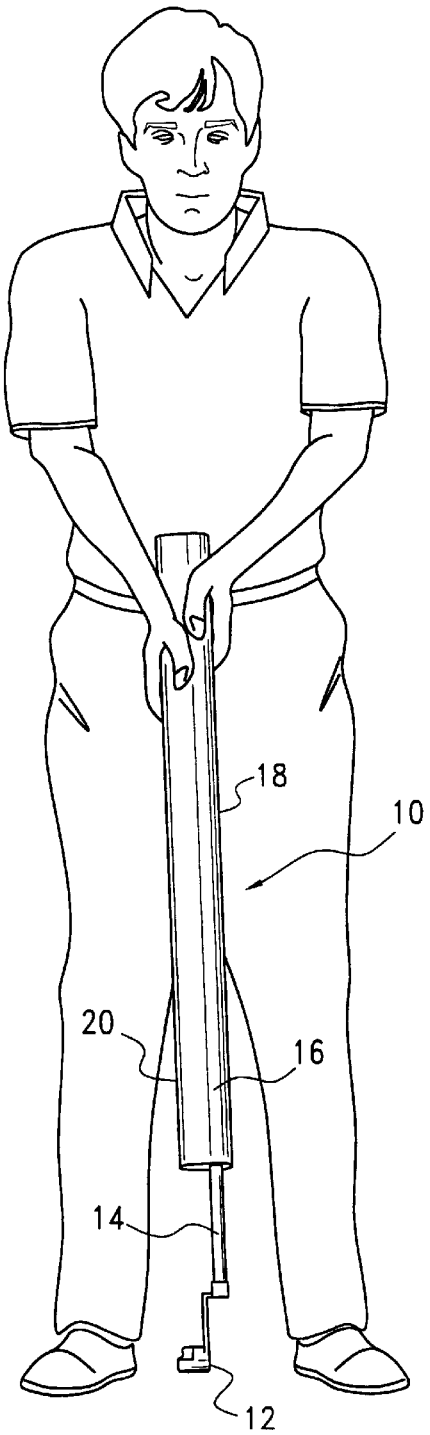
FIG. 2 is a front elevational view of the putter handle of the present invention as it is held in a normal address position prior to the execution of a putting stroke.
Figure 1:
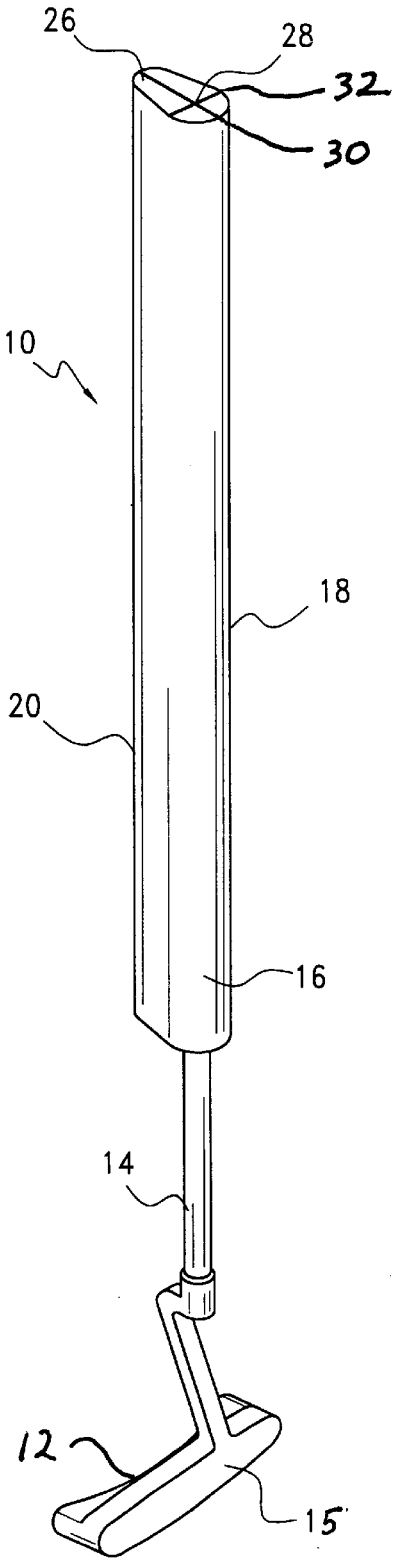
FIG. 1 is a perspective view of a first embodiment of a putter type golf club with a handle in accordance with the present invention.
Figure 3:
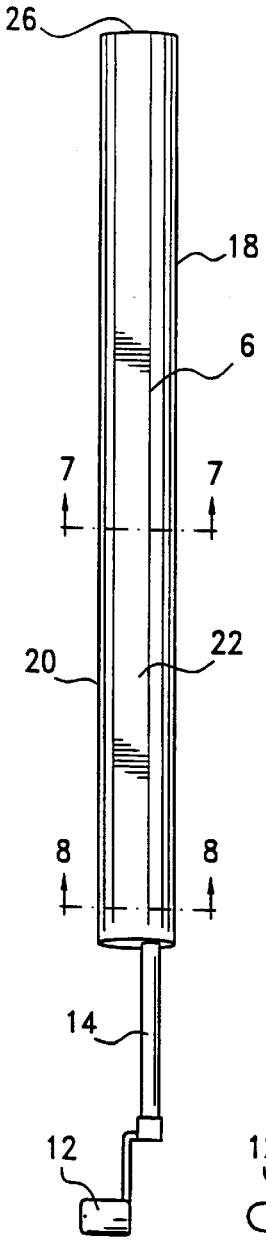
FIG. 3 is a front elevational view of the putter handle of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

FIGS. 1–8 show a first embodiment of a putter type golf club 10 in accordance with the present invention. The golf club 10 includes a club head 12, with a ball striking face 15 having a plane running there along, and a shaft 14 connecting the club head to handle 16. It will be appreciated that the putter head 12 can be any one of a number of conventional or non-conventional designs including a blade type, a heel-toe weight configuration or a mallet. The upper portion of the golf club 10 is formed with a unique, elongated, wide handle 16 with a rounded forward edge 18 and a rounded rearward edge 20 connected to the upper portion of the shaft 14. Preferably the handle 16 is made of wood, composite resin and/or plastic material. It may be provided with an integrally formed or an attached gripping surface to facilitate the grip of a golfer. Alternately, the handle and shaft may be molded as a single unit for connection with a club head, without departing from the spirit and scope of the invention.

Preferably the handle 16 is longer in length, that is in a direction toward the club head 12, than handles used with conventional putter type golf clubs. This feature allows the club to be gripped much lower with the dominant hand. In preferred embodiments, the handle 16 is approximately half of the overall length of the putter type golf club 10 from ground engaging end 17 up to handle end 26, but preferably is between 17 to 20 inches in length. The exact length is not a critical factor as long as a golfer's hands can be comfortably placed on the handle 16 using a comfortable grip, such as a conjoined or a split configuration.

Figure 6:
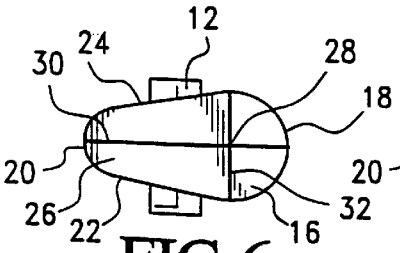
FIG. 6 is a top view of the putter handle.
Figure 7:
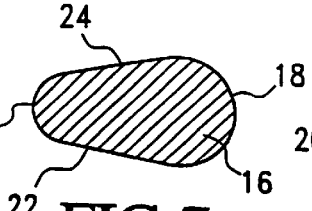
FIG. 7 is a sectional view taken along the line 7—7 of FIG. 3.
Figure 8:
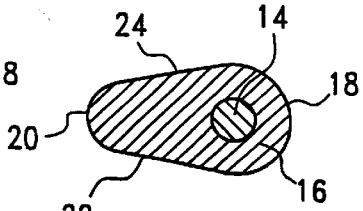
FIG. 8 is a sectional view taken along the line 8—8 of FIG. 3.

Referring to FIGS. 6, 7 and 8, it can be seen that the handle 16 is generally oval in cross section, with rounded edges 18 and 20 and flat wide sides 22 and 24. In a direction perpendicular to the plane of the ball striking face 15, the handle 16 is between one and two inches in depth, preferably approximately 1¾ inches, when measured along the maximum distance between the edges 18 and 20. The maximum width of the handle 16, as measured at the rounded front edge 18, is one inch or less. Thus, the elongated depth dimension of the oval cross section of the handle 16, in a direction perpendicular to the plane running along the ball striking face 15, is between 1.5 and 3 times the largest width of the oval cross section in a direction parallel to the plane running along the ball striking face 15, the ratio being at least 3 to 2. This presents a handle 16 which is much longer in depth, that is a direction perpendicular to the plane running along the ball striking face 15 and much narrower in width that is a direction parallel to the plane running along the ball striking face 15. In this embodiment the rounded forward edge 18 has a larger, first radius approximately a half inch whereas the rounded rear edge 20 of the handle 16 has a smaller, second radius of approximately ⅜ of an inch. This configuration creates a slightly flattened, oval cross sectional shaped handle 16 with a slight rearward taper when the putter type golf club 10 is aligned on a support surface in a direction toward an intended target. Preferably a golfer's non-dominant hand will be placed around of the forward edge 18 having the larger radius whereas the dominant hand is placed on the rearward edge 20 having the smaller radius, the flat side surfaces of the handle 22 and 24 being generally tapered at a slight angle therebetween. In the preferred embodiment, the shaft 14 engages the handle toward the front edge 18, as shown in the sectional view of FIG. 8, so that the shaft 14 is generally symmetrical within the radius formed at the front edge 18.

Figure 4:
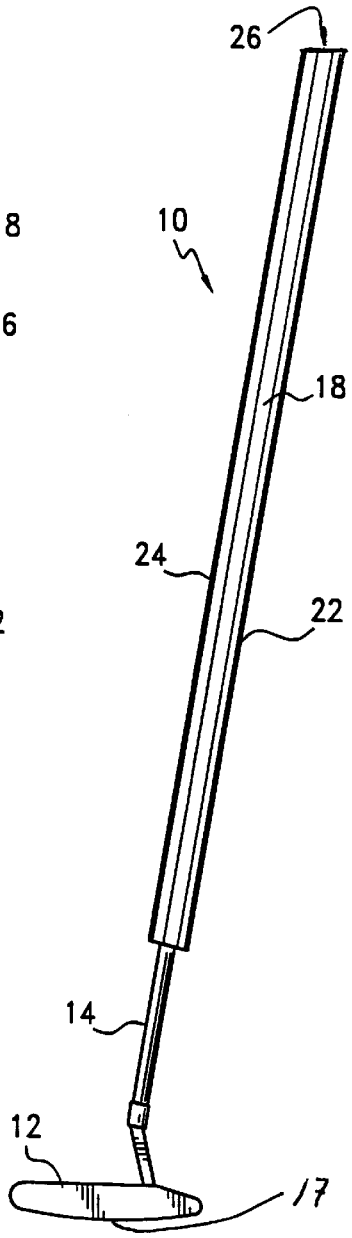
FIG. 4 is an end elevational of the putter handle in a direction toward an intended target.
Figure 5:
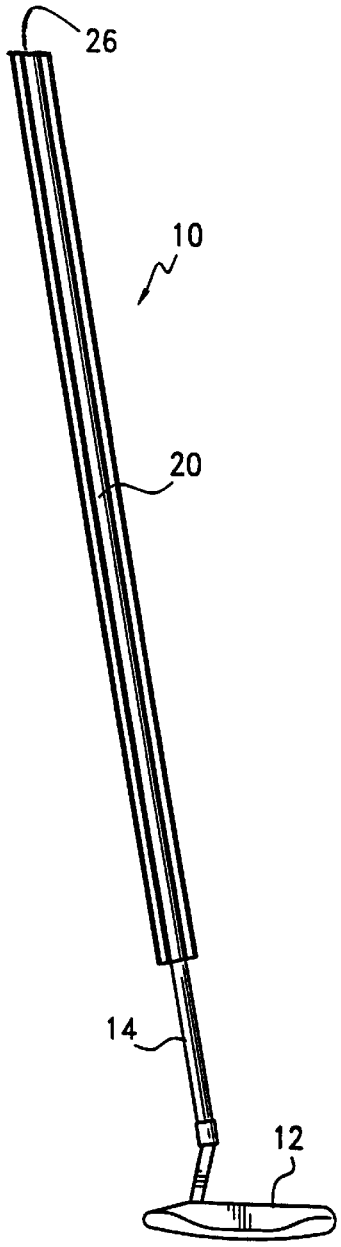
FIG. 5 is an end elevational of the putter handle in a direction away from an intended target.

The top surface 26 of the handle 16 is angled slightly so as to be exactly parallel to the bottom of the club head 12 as seen in FIGS. 4 and 5 to enable the golfer to more readily determine the correct position relative to the horizontal of the putter club head 12. The top surface includes a cross-hair alignment indicia 28 including a first alignment line 30 which bisects the longer longitudinal direction of the handle and is parallel to the target line when the putter is properly aligned. A second alignment line 32 is perpendicular to the first alignment line 30 and is parallel to the plane running along the ball striking face 15 of the putter head 12. This second line 32 assists the golfer to place the ball striking face 15 of the putter head 12 in a precise direction toward the intended target. Further, the first alignment line 30 can be used to align with a reference point on a user's non dominant hand. The reference point on the user's hand is determined after a few practice putts have been made. Thus, on any given day the user can pick a spot on their hand and continue to align line 30 up therewith to obtain straight putts for the day.

In use, a golfer places the bottom of the club head 12 on a putting surface and aligns the ball striking face to the intended target line using the alignment indicia 28 on the top surface 26 of the handle. The golfer then grips the handle 16 with both hands, either separated or conjoined, by placing the rounded front edge 18 and the rounded rear edge 20 into the palms of the golfer's hands. The palm of non-dominant hand is located on the forward edge 18 and the palm of the dominant hand is located on the rearward edge 20 in a position lower than the non-dominant hand. Because the handle 16 is has such a large depth, the golfer is not able to close his hands around the handle 16 as he would be able to do with a conventional round grip. This allows the muscles of the hands to be more relaxed thereby minimizing the tendency for the hand muscles to overpower the larger muscles of the upper arms and shoulders. A resulting putting stroke becomes much more smooth without the tendency of the putter face to close, due to the inaction of the hands. Also because the handle 16 has such a large depth the golfer's dominant hand is forced to be offset behind the shaft 14.

Further the method of use for putting involves using a putter type golf club including a club head having a ball striking face lying in a first plane and having a bottom surface in a second plane perpendicular to said first plane, a shaft connected to the club head having a front edge toward the target direction and an elongated handle which is longer in depth direction perpendicular to the plane of said ball striking face than in the width direction parallel to the plane of the ball striking face; wherein a user grips the handle with their non-dominant hand approximate the top front edge and their dominant hand on the rear edge such that the hands are separated and the dominant hand is offset behind the shaft.

Figure 9:
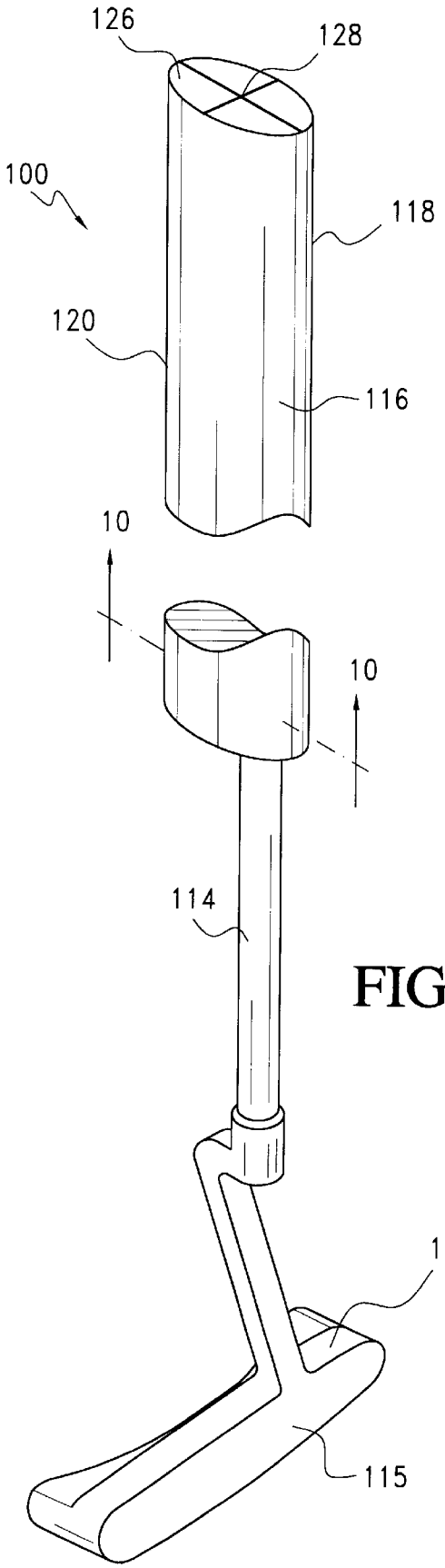
FIG. 9 is perspective view of another embodiment of a putter with a handle in accordance with the present invention.
Figure 10:
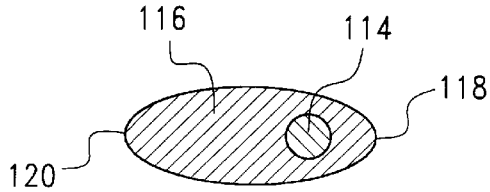
FIG. 10 is a sectional view taken along the line 10—10 of FIG. 9.

FIGS. 9 and 10 discloses a second embodiment of a putter type golf club head 100 in accordance with the present invention, including a club head 112, shaft 114 and an elongated handle 116. In this embodiment the handle 116 is an elliptical oval shape as shown by the upper surface 126 shown in FIG. 9, and with reference to the sectional view of FIG. 10. It will be appreciated that the elongated axis of the oval shape of the handle 116 is perpendicular to the plane running along the ball striking face 115. In an elliptical oval the front edge 118 and rear edge 120 are mirror images of each other as they have the same radius of curvature and the wide sides are not flat. The cross-hair type alignment mark 128 is centrally located on the top surface 126 of the handle 116. The shaft 114 is connected toward the front edge 118 of the handle 116.

Figure 11:
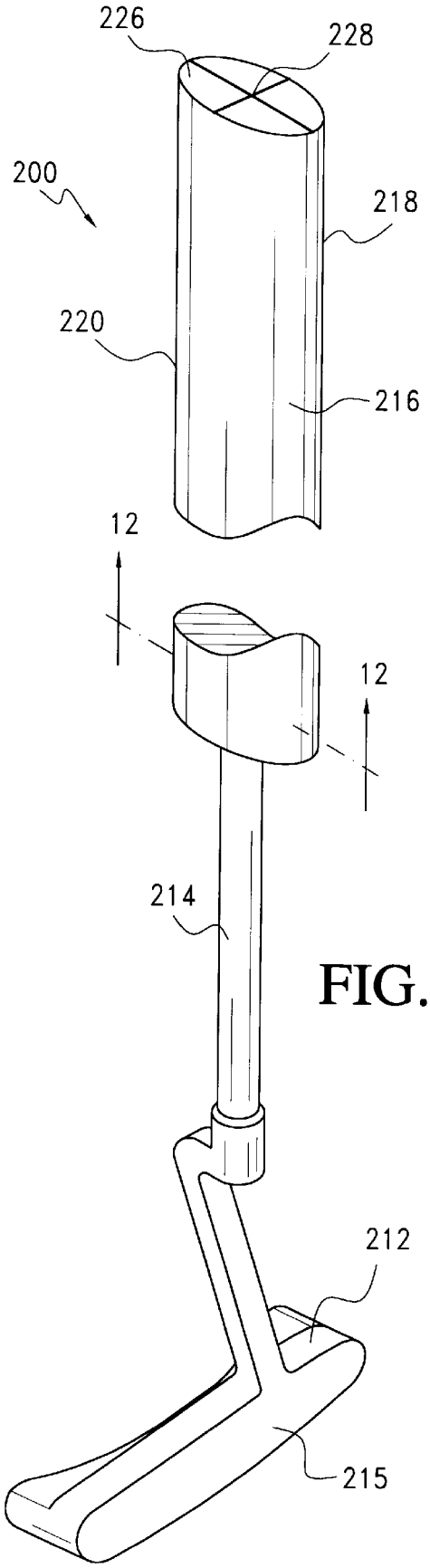
FIG. 11 is perspective view of still another embodiment of a putter with a handle in accordance with the present invention.
Figure 12:
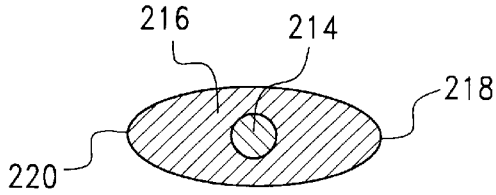
FIG. 12 is a sectional view taken along the line 12—12 of FIG. 11.

FIGS. 11 and 12 discloses a third embodiment of a putter type golf club head 200 in accordance with the present invention, including a club head 212, shaft 214 and an elongated handle 216. In this embodiment the handle 216 is an elliptical, oval shape as shown with reference to the sectional view of FIG. 10 and the upper surface 226 shown in FIG. 9. The elongated axis of the oval shape of the handle 216 is perpendicular to the ball striking face 215. The front edge 218 and rear edge 220 of the handle 216 are curved mirror images of each other. The cross-hair type alignment mark 228 is centrally located on the top surface 226 of the handle 216. The shaft 214 is centrally connected to the handle 216, as shown in the sectional view of FIG. 12.

While various preferred embodiments have been shown and described, it will be understood that there is no intent to limit the invention by such disclosure. For example the handle of the present invention has been described a being generally oval in cross-section. It will be appreciated the handle may take other configurations including a rectangular, trapazoidal or other similar shape. Therefore it is intended to cover all modifications and alternate constructions falling within the spirit and scope of the invention as defined in the appended claims.

What is claimed is:

1. A putter type golf club including a club head having a ball striking face lying in a first plane and a shaft having a lower end connected to the club head and an upper end, wherein the improvement comprises:

an elongated handle having an upper edge and a lower edge, said handle being attached to said shaft and having a generally oval, cross-sectional shape along the entire handle from said upper edge to said lower edge;

said generally oval, cross-sectional shape of said elongated handle including a first rounded forward edge and a second rounded rearward edge defining a cross-sectional, length dimension of said handle; a first flat side surface and a second opposing flat side surface defining a width dimension of said handle; said cross-sectional, length dimension being perpendicular to said first plane of said ball striking face; said handle being further defined by said first rounded forward edge having a first radius and said second rounded rearward edge having a second smaller radius; said flat side surfaces gradually tapering closer, each to the other, in a forward to rearward edge direction; said handle being further defined by said cross-sectional, length dimension of said oval, cross-sectional shape being at least 1.5 times greater than the largest width dimension between said side surfaces of said handle.

2. The putter type golf club of claim 1 wherein said handle extends at least half of the overall length of the golf club from said club head to said upper end of said shaft.

3. The putter type golf club of claim 1 wherein the shaft and handle connect to be offset toward the first rounded forward edge of said handle.

4. The putter type golf club of claim 1 wherein said upper edge of said elongated handle further includes a flat upper surface with alignment indicia thereon, for aligning said club head in a preselected direction toward an intended target.

5. The putter type golf club of claim 4 wherein said alignment indicia forms a cross-hair with a first alignment line bisecting said oval shaped handle between said first rounded forward edge and said second rounded rearward edge in a direction perpendicular to said ball striking face and a second alignment line, perpendicular to said first alignment line.

* * * * *